US008394204B2

(12) United States Patent
Buerkle et al.

(10) Patent No.: US 8,394,204 B2
(45) Date of Patent: Mar. 12, 2013

(54) COMMERCIAL DISHWASHER WITH CENTRIFUGAL PUMPS ARRANGED IN SERIES

(75) Inventors: Udo Buerkle, Hohberg (DE); Martin Schrempp, Gengenbach (DE)

(73) Assignee: Premark FEG L.L.C., Glenview, IL (US)

( * ) Notice: Subject to any disclaimer, the term of this patent is extended or adjusted under 35 U.S.C. 154(b) by 776 days.

(21) Appl. No.: 12/125,093

(22) Filed: May 22, 2008

(65) Prior Publication Data

US 2008/0289655 A1 Nov. 27, 2008

(30) Foreign Application Priority Data

May 26, 2007 (DE) ..... 10 2007 024 799

(51) Int. Cl.
*B08B 3/00* (2006.01)
*B08B 3/12* (2006.01)
*B08B 6/00* (2006.01)

(52) U.S. Cl. ..... 134/56 D; 134/57 D; 134/58 D; 134/184

(58) Field of Classification Search ..... 134/56 D, 134/57 D, 58 D, 184
See application file for complete search history.

(56) References Cited

U.S. PATENT DOCUMENTS 4,439,242 A * 3/1984 Hadden ..... 134/25.2
4,561,904 A * 12/1985 Eberhardt, Jr. ..... 134/18
5,213,477 A * 5/1993 Watanabe et al. ..... 417/20
6,651,900 B1 * 11/2003 Yoshida ..... 239/72
7,021,321 B2 * 4/2006 Bigott ..... 134/56 R
2007/0131260 A1 6/2007 Scheringer et al.

FOREIGN PATENT DOCUMENTS

DE 2304035 C2 8/1974
DE 10133108 A1 1/2003
DE 103-39-130 3/2004
DE 10-2005-023-429 11/2006
DE 102005035764 A1 2/2007
DE 102005039140 A1 2/2007
DE 102005039385 A1 2/2007
EP 1637058 A3 9/2005
EP 1637059 B1 9/2005

(Continued)

OTHER PUBLICATIONS

JP 2001-241703 Machine Translation Sep. 2001 Fujisaki et al.*

(Continued)

*Primary Examiner* — Michael Barr
*Assistant Examiner* — Charles W Kling
(74) *Attorney, Agent, or Firm* — Thompson Hine LLP

(57) ABSTRACT

A commercial dishwasher comprising spray nozzles for spraying liquid into a treatment region in the form of a treatment chamber or a treatment zone for treating items to be washed; at least two centrifugal pumps, which are arranged in series hydraulically one behind the other, for conveying liquid from the wash tank to the spray nozzles; a control device for alternatively operating only one centrifugal pump or at least two of the centrifugal pumps which are connected hydraulically one behind the other in series, in order to thus generate different liquid pressures.

20 Claims, 3 Drawing Sheets

FOREIGN PATENT DOCUMENTS

| | | | | |
|---|---|---|---|---|
| EP | 1815779 | B1 | | 10/2006 |
| EP | 2005873 | | | 12/2008 |
| FR | 2540720 | B1 | | 8/1984 |
| JP | 57124089 | A | * | 8/1982 |
| JP | 2001241703 | A | * | 9/2001 |
| WO | WO 2004020727 | A2 | * | 3/2004 |
| WO | WO 2005/070276 | | | 8/2005 |
| WO | WO 2006-007236 | | | 1/2006 |

OTHER PUBLICATIONS

WO 2004-020727 English Translation Mar. 2004 WIPO Schrott.*

H. Siekmann, Berlin; Principal R Current Machines; Section "3 Kreiselpumpen" in; W. Beitz and K.H. Kuttner Double Paperback for the Mechanical Engineering Appeared in Springer Veriag, Berlin—1990; ISBN 3-540-52381-1; 17; Edition, Side R41.

* cited by examiner

COMMERCIAL DISHWASHER WITH CENTRIFUGAL PUMPS ARRANGED IN SERIES

TECHNICAL FIELD

The application relates to a commercial dishwasher, more particularly to a pump arrangement for a commercial dishwasher that provides for varying water pressure conditions during operation.

BACKGROUND

Commercial dishwashers for which the invention can be used include program-controlled dishwashers (called batch dishwashers or batch warewashers or else box machines), conveyor dishwashers (conveyor warewashers) in the form of, for example, flight-type dishwashers (flight-type warewashers) or in the form of rack conveyor dishwashers (rack conveyor warewashers) and hood-type dishwashers (hood-type warewashers). The program-controlled dishwashers have a single treatment chamber for accommodating and for treating items to be washed. A dish rack into which the items to be washed can be loaded is preferably provided. The treatment chamber can be closed by a door. The conveyor dishwashers have at least one wash zone and at least one final rinse zone. Hood-type dishwashers have a treatment zone beneath a hood which is arranged such that the hood can move up and down.

A program-controlled dishwasher is known, for example, from DE 10 2005 023 429 A1. Conveyor dishwashers are known, for example, from WO 2006/007236 A2, EP 1 637 059 A2 and DE 10 2005 035 764 A1.

Items to be washed include, in particular, crockery, glasses, cutlery, cooking utensils, baking utensils and serving trays.

When cleaning items in commercial dishwashers, in particular in program-controlled dishwashers, it is often necessary to have cleaning programs with different liquid pressures, which are matched to the items to be washed, for the wash liquid and/or for the final rinse liquid.

If an electrical centrifugal pump whose polarity can be reversed and which can be changed over from two-pole operation to four-pole operation is used to deliver the wash liquid, a reduction in the rotational speed of the pump motor from 3000 revolutions per minute to 1500 revolutions per minute can be achieved on account of such polarity reversal. This reduction in the rotational speed causes a change in the water pressure at the pump output (pressure side of the pump). However, halving the rotational speed of the pump motor (and therefore also the rotational speed of the pump) in this way does not halve the water pressure. Instead, the water pressure changes from approximately 1.0 bar at 3000 revolutions per minute to approximately 0.25 bar at 1500 revolutions per minute. This disproportionate change means that the wash liquid pressure is often too low for glasses and crockery. A wash liquid pressure of approximately 0.5 bar would be more advantageous. The liquid pressure acting on the items to be washed is dependent on the line system, for example wash system and/or final rinse system, installed in the dishwasher.

It would be desirable to provide a way of alternatively generating in each case two different liquid pressures in a simple manner, with each liquid pressure being matched to the different items to be cleaned.

SUMMARY

In general, a commercial dishwasher in which at least two centrifugal pumps which are connected in series are arranged upstream of at least one wash system and/or a final rinse system.

According to one particular feature, the two pumps have identical pump characteristic curves.

According to another embodiment, the two pumps have different pump characteristic curves.

According to one advantageous embodiment, operation only with the upstream pump of the two pumps which are arranged in series or with both pumps is alternatively possible.

According to another advantageous embodiment, operation only with the downstream pump of the two pumps which are arranged in series or with both pumps is alternatively possible.

According to a likewise advantageous embodiment, in particular if one of the two pumps has a different delivery rate than the other pump, operation of only one pump or only the other pump or of both pumps at the same time is alternatively provided.

According to one particular embodiment, soft-starting and therefore a gentle increase in pressure is achieved by initially only one of the two pumps being switched on at the start of a wash cycle or a final rinse cycle and the other pump being additionally switched on after a predetermined time delay or after a time delay determined by other criteria.

BRIEF DESCRIPTION OF THE DRAWINGS

The invention is described below with reference to the attached drawings using preferred embodiments as examples.

DETAILED DESCRIPTION

A pump with a power of, for example, 1.1 kW achieves a liquid pressure of, for example, 0.5 bar in a wash system or final rinse system, as can be used in program-controlled dishwashers or in a conveyor dishwasher.

In order to alternatively achieve a liquid pressure at the low pressure of, for example, 0.5 bar and a high pressure of, for example, 1.0 bar, two standard pumps can be connected hydraulically in series one behind the other.

The pressures of two pumps which are arranged hydraulically one behind the other are added. Therefore, the pressure approximately doubles in the case of two centrifugal pumps of equal size which are arranged hydraulically one behind the other. The volumetric flow is only insignificantly changed as a result.

In practice, this means that increases in power which correspond to the pump components are produced for the two pump components of the hydraulic power (pressure and volumetric flow). This is explained below with reference to the graph of the pump characteristic curves from FIG. 1.

Figure 1:
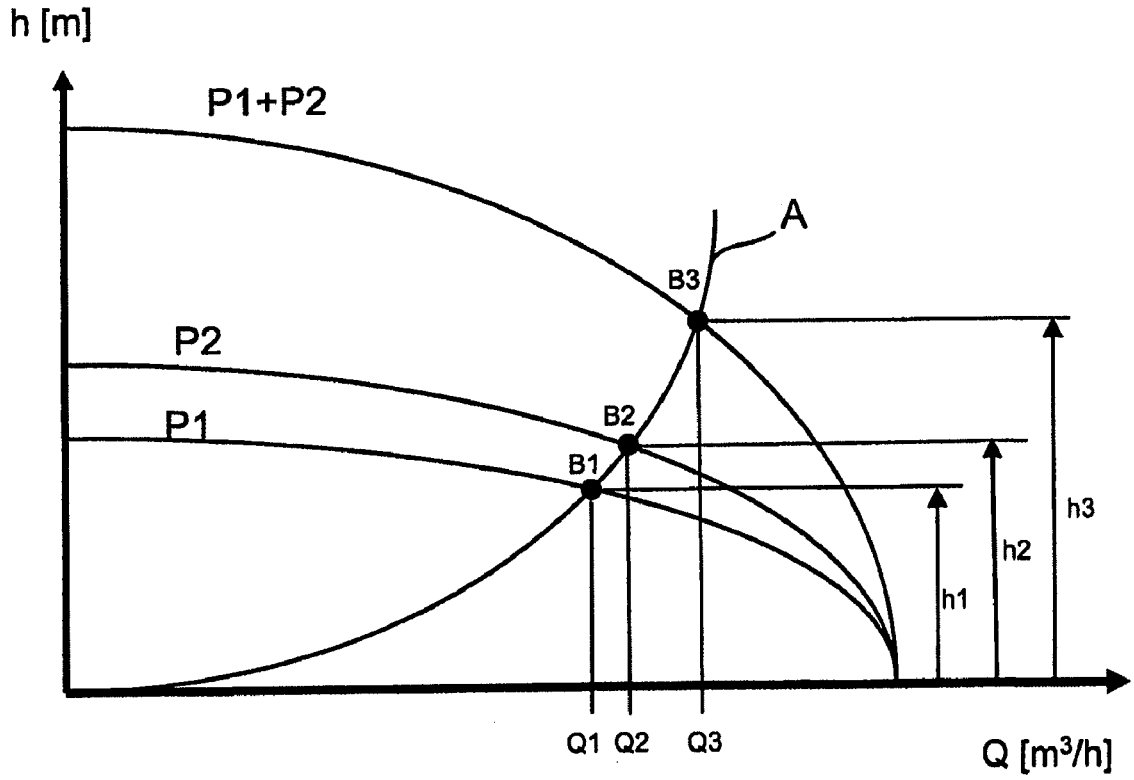
FIG. 1 shows a graph with pump characteristic curves with two pumps connected in series.

The delivery level h in miters (m) is specified on the vertical axis of the characteristic graph from FIG. 1. The volumetric flow Q in m3/h is specified on the horizontal axis of the characteristic graph. P1 denotes the characteristic curve of a pump 1; P2 denotes the characteristic curve of a further pump 2 which is connected in series to the pump 1; and P1+P2 denotes the pump characteristic curve of the series circuit comprising the two pumps 1 and 2. The pump characteristic curves cross the system characteristic curve "A" which is dependent on the respective line system of the dishwasher. B1 denotes an operating point of one pump 1; B2 denotes an operating point of the other pump 2; and B3 denotes an operating point of the series circuit comprising the two pumps 1 and 2.

The characteristic graph from FIG. 1 shows, using the plotted levels h1, h2 and h3, that the increase between each of the individual pump characteristic curves P1 and P2 and the common characteristic curve P1+P2 of the series circuit comprising the two pumps 1 and 2 is more pronounced when the system characteristic curve "A" between the operating points B1, B2 and B3 is steeper. On the horizontal axis of the characteristic graph, it can be seen in terms of volumetric flow Q that the increase in the volumetric flow Q1 of one pump or in the volumetric flow Q2 of the other pump is relatively low compared to the volumetric flow Q3 of the series circuit comprising the two pumps.

The configuration of the series circuit provides the option of operating only the pump 1 for low-pressure operation and of starting the pump 1 and the pump 2 at short intervals one after the other (or at the same time) and then operating both pumps together for high-pressure operation.

When operating both pumps 1 and 2, which may be of identical design, in series, the liquid pressure at the spray nozzles of the dishwasher is virtually doubled if the two pumps 1 and 2 have identical pump characteristic curves.

During operation of the one pump 1 (or pump 2) alone, the liquid pressure is reduced only slightly by hydraulic losses as the liquid flows through the other pump 2 (or pump 1) in question.

Instead of identical pumps 1 and 2, it is of course also possible to use two pumps which have different powers or different characteristic curves.

During operation of the pump 2 alone, the liquid pressure can therefore, depending on the design of the line system, be higher or lower than when only pump 1 is in operation. Thus, it is possible to achieve three different liquid pressures of wash liquid or final rinse liquid by combining just two pumps 1 and 2.

Figure 2:
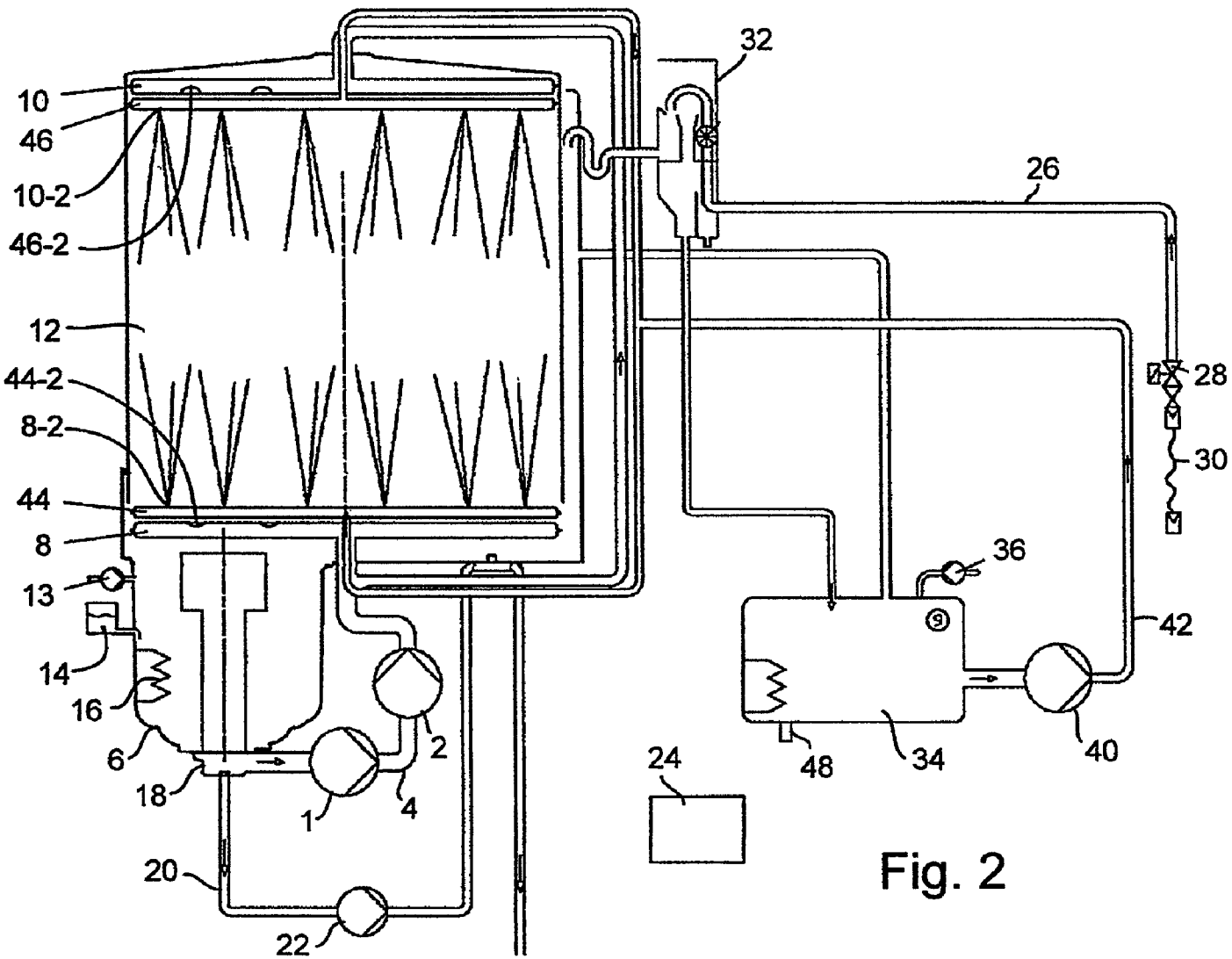
FIG. 2 schematically shows an embodiment of a program-controlled dishwasher.

FIG. 2 schematically shows a commercial dishwasher in the form of a program-controlled dishwasher. It contains two pumps 1 and 2, called wash pumps in the text which follows, which are arranged in series one behind the other, in a wash liquid feed line 4 which hydraulically connects the lower end of a wash tank 6 to at least one lower wash arm 8 and one upper wash arm 10. The wash arms 8 and 10 are located in a treatment chamber 12 respectively below and above the accommodation region for the items to be washed and are each provided with spray nozzles 8-2 and 10-2, respectively, which are directed towards the items to be washed.

A cleaning agent metering pump 13 can be provided in order to supply cleaning agent to the wash tank 6.

A pressure switch 14 can be provided for monitoring the liquid level in the wash tank 6.

A heating arrangement 16 can be provided in order to heat up the wash liquid in the wash tank 6.

A discharge line 20 with a discharge pump 22 can be connected to a sump 18 of the wash tank 6.

The two wash pumps 1 and 2 from FIG. 2, which are arranged in series (one behind the other), are switched on by a control device 24 using at least one application program. The pumps are switched on individually or in combination according to at least one of the variants which were described above with reference to FIG. 1 or as defined in the patent claims.

The upstream start of a fresh water supply line 26 can be connected to a fresh water supply hose 30 via a solenoid valve 28. The downstream end of the fresh water supply line 26 is connected to a water inlet apparatus 32 by which fresh water can flow into a water heater 34. A supply line, for example a metering pump 36, is connected to the water heater 34 for supplying final rinse agent. The final rinse liquid of the water heater 34 is conducted through a final rinse pump 40 through a feed line 42 for final rinse liquid to at least one lower wash arm 44 and at least one upper wash arm 46, and sprayed through spray nozzles 44-2 and 46-2 of the lower and upper arms respectively into the treatment chamber 12 and onto the items to be washed (not shown).

The water heater 34 can be provided with an emptying apparatus 48 (e.g., a drain path).

Instead of just one final rinse pump 40, two final rinse pumps can be arranged in series and switched on alternatively in accordance with at least two different variants as have been described with reference to FIGS. 1 and 2 for the wash pumps 1 and 2.

Figure 3:
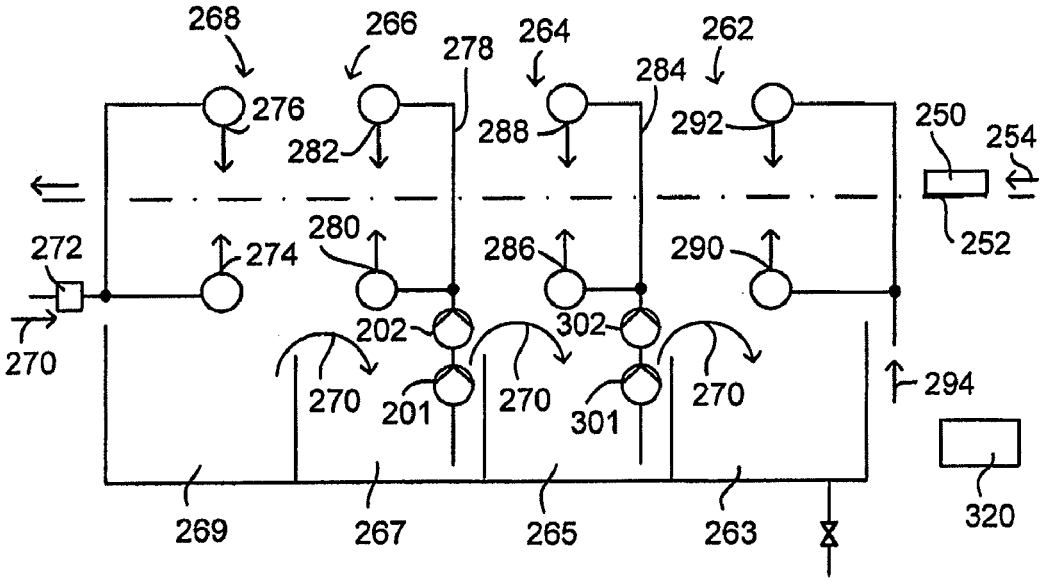
FIG. 3 schematically shows an embodiment of a conveyor dishwasher.

FIG. 3 shows a conveyor dishwasher in which items 250 to be washed are transported from a transportation apparatus 252 in a transportation direction 254. The dishwasher contains a prewash zone 262, a first wash zone 264, a second wash zone 266 and a final rinse zone 268. Each zone contains a tank 263, 265, 267, and 269 respectively for accommodating the liquid sprayed into the zone in question. The tanks 269, 267, 265 and 263 form a cascade circuit in which liquid flows over into the adjacent tank in a liquid direction 270, with the liquid flow direction 270 from tank to tank opposing the transportation direction 254.

Final rinse liquid can be supplied to spray nozzles 274 and 276 which are arranged in the final rinse zone 268 above and below the transportation apparatus 252 by means of a supply device 272 for final rinse liquid.

Wash liquid can be conveyed from the second wash tank 267 to spray nozzles 280 and 282 which are arranged in the second wash zone 266 respectively below and above the transportation apparatus 252 through one and/or the other of two pumps 201 and 202, which are arranged in series one behind the other, in a wash liquid line system 278. The two wash pumps 201 and 202 can be switched on individually or together, as has been described above with reference to FIGS. 1 and 2 in terms of pumps 1 and 2.

A further wash liquid line system 284 contains a series arrangement of two wash pumps 301 and 302 for conveying wash liquid from the wash tank 265 to lower and upper spray nozzles 286 and 288 respectively in the second wash zone 264. The two pumps 301 and 302 which are arranged in series can be switched on individually or together, as has been described above with reference to pumps 1 and 2 from FIGS. 1 and 2.

The prewash zone 262 contains lower spray nozzles 290 and upper spray nozzles 292 for spraying prewash liquid 294 onto the items 250 to be cleaned.

The conveyor dishwasher from FIG. 3 is controlled by a control device 320 which, for this purpose, contains at least one application program.

Figure 4:
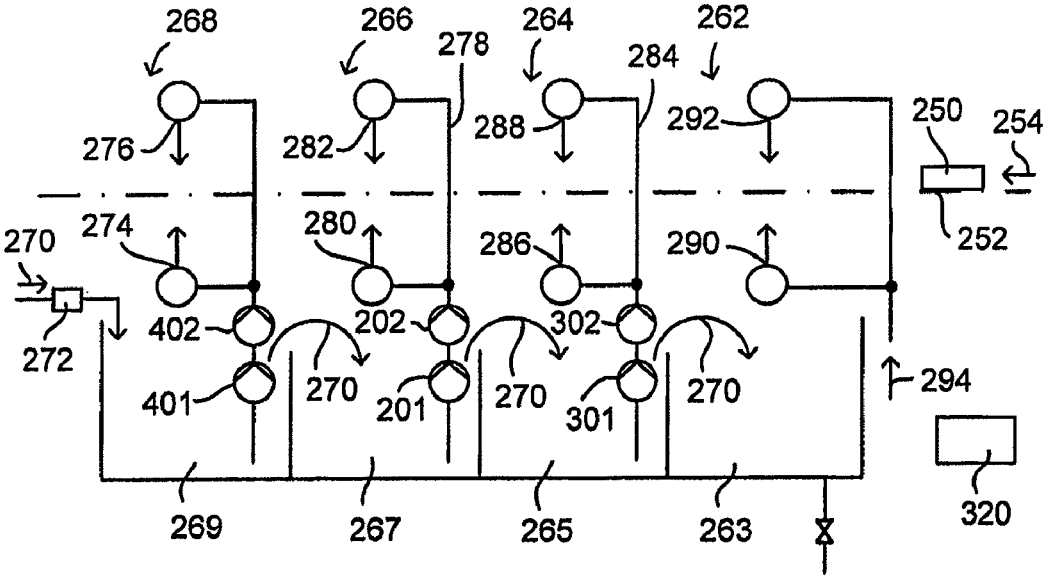
FIG. 4 schematically shows another embodiment of a conveyor dishwasher.

FIG. 4 shows a further embodiment of a conveyor dishwasher, in which parts which correspond to FIG. 3 are provided with the same reference numerals, and which differs from FIG. 3 in that the supply device 272 for final rinse liquid conducts the final rinse liquid into the final rinse liquid tank 269. The final rinse liquid is conveyed from the tank 269 through the series circuit comprising two pumps 401 and 402 to the lower and upper spray nozzles 274 and 276, respectively, of the final rinse zone 268. The final rinse liquid can be conveyed with at least two different pressures, as has been described above with reference to the pumps 1 and 2 from FIGS. 1 and 2.

According to yet another embodiment, which is not illustrated in the drawings, it is also possible to convey liquid from the tank of one zone to spray nozzles of another zone using the series circuit comprising two pumps.

In all the illustrated embodiments, the control device is designed in such a way that at least two variants from amongst the possible operating variants of a series circuit comprising two pumps can be alternatively implemented:

switching on only the upstream pump, switching on only the downstream pump, switching on both pumps, with the result that at least sometimes both pumps convey or move liquid at the same time. For simultaneous operation of the two pumps, the variants include either switching on both pumps at the same time or additionally switching on one pump after the other pump with a time delay.

The variants are preferably switched on automatically by at least one application program (cleaning program) of the control device. Furthermore, embodiments are also possible in which the variants can be switched on only manually or alternatively automatically or manually.

Instead of two pumps, a plurality of, for example three, pumps can also be arranged hydraulically in series (one behind the other).

The invention claimed is:

1. A commercial dishwasher comprising:

a treatment region in the form of a treatment chamber or a treatment zone for holding items to be washed;

spray nozzles for spraying liquid into the treatment region;

a tank below the treatment region for holding liquid to be provided to the spray nozzles;

a pump arrangement including at least an upstream centrifugal pump and a downstream centrifugal pump arranged hydraulically in series for conveying liquid from the tank to the spray nozzles; and a control device for selectively operating only one of the upstream centrifugal pump or the downstream centrifugal pump or both the upstream centrifugal pump and the downstream centrifugal pump in order to selectively generate different liquid pressures;

the spray nozzles located external of and above the tank for spraying liquid onto items that are external of and above the tank.

2. The dishwasher according to claim 1, characterized in that a suction side of the upstream centrifugal pump is connected to receive liquid from the tank, and a pressure side of the downstream centrifugal pump is connected to deliver liquid to the spray nozzles.

3. The dishwasher according to claim 1, characterized in that the control device is operable to selectively switch on the upstream centrifugal pump without switching on any other pump in the pump arrangement.

4. The dishwasher according to claim 1, characterized in that the control device is operable to selectively switch on the downstream centrifugal pump without switching on any other pump in the pump arrangement.

5. The dishwasher according to claim 1, characterized in that all the centrifugal pumps of the pump arrangement are designed for the same delivery rate.

6. The dishwasher according to claim 1, characterized in that the upstream centrifugal pump has a different delivery rate than the downstream centrifugal pump.

7. The dishwasher according to claim 1, characterized in that the upstream centrifugal pump and the downstream centrifugal pump have identical pump characteristic curves.

8. The dishwasher according to claim 1, characterized in that the upstream centrifugal pump has a different pump characteristic curve than the downstream centrifugal pump.

9. The dishwasher according to claim 1, characterized in that the dishwasher is a program-controlled dishwasher and the treatment region is a treatment chamber into which the items to be washed can be manually inserted.

10. The dishwasher according to claim 1, characterized in that the dishwasher is a conveyor-type dishwasher, the treatment region is a first treatment zone, at least a second treatment zone is provided, and a delivery apparatus is provided for automatically transporting items being washed through the treatment zones.

11. The dishwasher according to claim 1, characterized in that the treatment region is a wash chamber or a wash zone and the liquid is wash liquid.

12. The dishwasher according to claim 1, characterized in that the treatment region is a final rinse chamber or a final rinse zone and the liquid is final rinse liquid.

13. A commercial dishwasher comprising:

a treatment region in the form of a treatment chamber or a treatment zone for treating items to be washed;

spray nozzles for spraying liquid into the treatment region;

at least one tank for providing liquid to the spray nozzles, wherein the spray nozzles are located external of and above the tank for spraying liquid onto items that are external of and above the tank;

a pump arrangement including at least an upstream centrifugal pump and a downstream centrifugal pump arranged hydraulically in series for conveying liquid from the tank to the spray nozzles; and a control device for selectively operating only one of the upstream centrifugal pump or the downstream centrifugal pump or both the upstream centrifugal pump and the downstream centrifugal pump in order to selectively generate different liquid pressures wherein the control device is programmed to operate during flow start-up to automatically first switch on only one of the upstream or downstream centrifugal pumps and only after a time interval then additionally switch on the other of the upstream or downstream centrifugal pumps for operation hydraulically in series, such that two different liquid pressures are generated one after the other, of which the first liquid pressure is lower than the second liquid pressure.

14. The dishwasher according to claim 13, characterized in that the time interval is defined by a predetermined delay time.

15. The dishwasher according to claim 13, characterized in that the time interval is dependent on a predetermined operating criterion.

16. The dishwasher according to claim 15, characterized in that the predetermined operating criterion is one of the following: type of item to be washed, degree of soiling of the item to be washed, or degree of soiling of the liquid.

17. The dishwasher according to claim 13, characterized in that the control device is programmed such that all the centrifugal pumps of the pump arrangement are switched off at the same time.

18. The dishwasher according to claim 13, characterized in that the control device is programmed such that the centrifugal pumps of the pump arrangement are switched off one after the other.

19. A method for operating a commercial dishwasher according to claim 1, characterized by a step of automatically varying liquid pressure at the spray nozzles by program-controlled selective actuation of one or both of the upstream centrifugal pump and/or the downstream centrifugal pump.

20. A method for operating a commercial dishwasher according to claim 1, comprising the steps of:

automatically varying liquid pressure of liquid that is sprayed into the treatment chamber by program-controlled selective actuation of:

just one of the first centrifugal pump or the second centrifugal pump during a certain time; and both the first centrifugal pump and the second centrifugal pump at another time.

* * * * *